United States Patent [19]

Joynes et al.

[11] 4,020,635

[45] May 3, 1977

[54] POWER PLANTS

[75] Inventors: Brian Joynes; Wilfred Nicholas Bainbridge, both of Leamington Spa, England

[73] Assignee: Automotive Products Company Limited, England

[22] Filed: May 19, 1975

[21] Appl. No.: 579,003

[30] Foreign Application Priority Data

May 20, 1974 United Kingdom ..... 22347/74

[52] U.S. Cl. ..... 60/525; 60/517; 60/690; 60/698; 60/714

[51] Int. Cl.[2] ..... F02G 1/04

[58] Field of Search ..... 60/517–526, 60/690–693, 698, 714

[56] References Cited

UNITED STATES PATENTS 3,293,850 12/1966 Morrison ..... 60/648

FOREIGN PATENTS OR APPLICATIONS 523,269 4/1954 Belgium ..... 60/525
528,864 8/1956 Canada ..... 60/525

*Primary Examiner*—Allen M. Ostrager
*Attorney, Agent, or Firm*—Lawrence J. Winter

[57] ABSTRACT

A power plant comprising combustion means for generating heat for use in a power plant with at least two hot gas engines, comprising first and second working fluid spaces, reciprocating means for varying the volume of working fluid spaces, heating means adjacent said first working fluid space, a source of cooling fluid, first conduit means connecting said source of cooling fluid and said cooling means to convey cooling fluid from said source of cooling fluid to said cooling means to cool working fluid in said second working fluid space and means for conveying the products of combustion from said combustion means to the heating means to heat working fluid in said first working fluid space; second conduit means in communication with the cooling means one said hot gas engine and the combustion means to convey cooling fluid from the cooling means of said one hot gas engine to the combustion means for participation in combustion therein, the cooling means of said second hot gas engine being independent of the combustion means; and heat exchange means for transferring heat from cooling fluid fed from the cooling means of said one hot gas engine to the combustion means wherein, in operation of the plant, the cooling fluid fed from the cooling means of said one hot gas engine to the combustion means has had its physical state changed by heat which it absorbed in the cooling means of said one hot gas engine.

8 Claims, 3 Drawing Figures

POWER PLANTS

This invention relates to power plants which include at least one hot gas engine of the kind which comprises first and second working fluid spaces, regenerative heat exchange means interconnecting said first and second working fluid spaces, reciprocating means for varying the volume of the interconnected working fluid spaces, heating means for heating working fluid in said first working fluid space and cooling means for cooling working fluid in said second working fluid space.

A hot-gas engine of the kind referred to is arranged so that, when the engine is operated, the reciprocating volume varying means are urged to increase the volume of said first working fluid space by the expansion in that space of working fluid whilst heat is supplied to the working fluid in that space from the heating means and subsequently to reduce the volume of said second working fluid space in order to compress working fluid in the second working fluid space whilst heat is transferred from the working fluid in the second working fluid space to cooling fluid in the cooling means, heat extracted from the working fluid in the second working fluid space being absorbed by that cooling fluid, the working fluid being transferred between the working fluid spaces by the reciprocating volume varying means via the regenerative heat exchange means which takes heat from the working fluid as it is moved to said second working fluid space and restores heat to the working fluid as it is moved back to said first working fluid space, so that there is a change of temperature in the working fluid as it is transferred between the two working fluid spaces.

The thermal efficiency of existing power plants including combustion means and one or more hot gas engines of the kind referred to is exceptionally high. However, the values achieved are only fractions of the values predicted for the power plant operating on an ideal thermodynamic cycle.

An object of this invention is to provide a power plant including combustion means and one or more hot gas engines of the kind referred to, the thermal efficiency of the power plant being significantly higher than is the thermal efficiency of existing power plants including combustion means and one or more hot gas engines of the kind referred to.

According to this invention, there is provided a power plant including one or more hot gas engines of the kind referred to, and combustion means adapted to generate heat for use in the power plant, wherein the combustion means and the cooling means of the engine or one of the engines are interconnected by conduit means for conveying fluid from said cooling means to the combustion means for participation in combustion in the combustion means, fluid so conveyed having been used as cooling fluid in said cooling means and having had its physical state changed by heat which it absorbed in said cooling means and which was extracted from the working fluid in said second working fluid space.

Preferably the combustion means are associated with the heating means of the engine or of at least one of the engines so that, when the power plant is in operation, heat generated in said combustion means is supplied to the associated heating means for heating working fluid in the said first working fluid space of the respective engine or engines.

Preferably the power plant includes more than one hot gas engine of the kind referred to, the combustion means being associated with the heating means of at least two of the engines so that, when the power plant is in operation, heat generated by combustion in the combustion means is supplied to the associated heating means of the respective engines. The combustion means may comprise a common combustion chamber from which heat is supplied to the heating means of the respective engines. Conveniently the power plant includes heat-exchange means for cooling cooling fluid that is for use in the cooling means of at least one of the engines, which cooling means are not connected to the combustion means, and further conduit means interconnecting the heat exchange means and the combustion means, the further conduit means being adapted to convey fluid from said heat exchange means to the combustion means for participation in combustion therein, fluid so conveyed having been used as cooling fluid in said heat exchange means and having had its physical state changed by heat which it absorbed in said heat exchange means and which was extracted from the cooling fluid in said cooling means which are not connected to the combustion means.

Conveniently, the power plant includes second heat exchange means for transferring heat from cooling fluid to fluid that is conveyed from the cooling means of at least one of the engines to the combustion means, said cooling fluid being cooling fluid which is not fed to the combustion means and which is employed to extract heat from the working fluid in at least one of the engines.

Preferably the power plant includes third heat exchange means for transferring excess heat to fluid conveyed from the cooling means of one or more of the engines to the combustion means, heat so transferred being excess heat generated in the combustion means and preheating that fluid prior to the introduction of that fluid into the combustion means for participation in combustion therein.

Where the power plant includes more than two hot gas engines the heating means of at least one of the engines, which includes cooling means that are connected to the combustion means may be adapted to be supplied with solar energy for heating working fluid in the respective engine or engines. Alternatively the heating means of at least one of the engines which includes cooling means that are connected to the combustion means are adapted to be supplied with heat extracted from river water for heating working fluid in the respective engine or engines.

Preferably fluid conveyed by conduit means to the combustion means to participate in combustion therein comprises fuel or an oxidant. Such fluid which participates in combustion in the combustion means as fuel may comprise hydrogen, propane, butane, or any other hydrocarbon fuel having similar thermal properties. Such fluid which participates in combustion in the combustion means as an oxidant may include liquid air, liquid oxygen or any other oxidant having similar thermal properties. Cooling fluid in the cooling means which are not connected to the combustion means may comprise air or water. Hydrogen, helium or any other fluid having similar thermal properties may be used as working fluid.

The conduit means for conveying fluid which is the same as the working fluid employed in the engine or engines may be in communication with said working fluid spaces of the respective engine or engines. The regenerative heat exchange means of at least two engines may be interconnected.

One embodiment of this invention will be described now by way of example and with reference to the accompanying drawings, in which.

Figure 1:
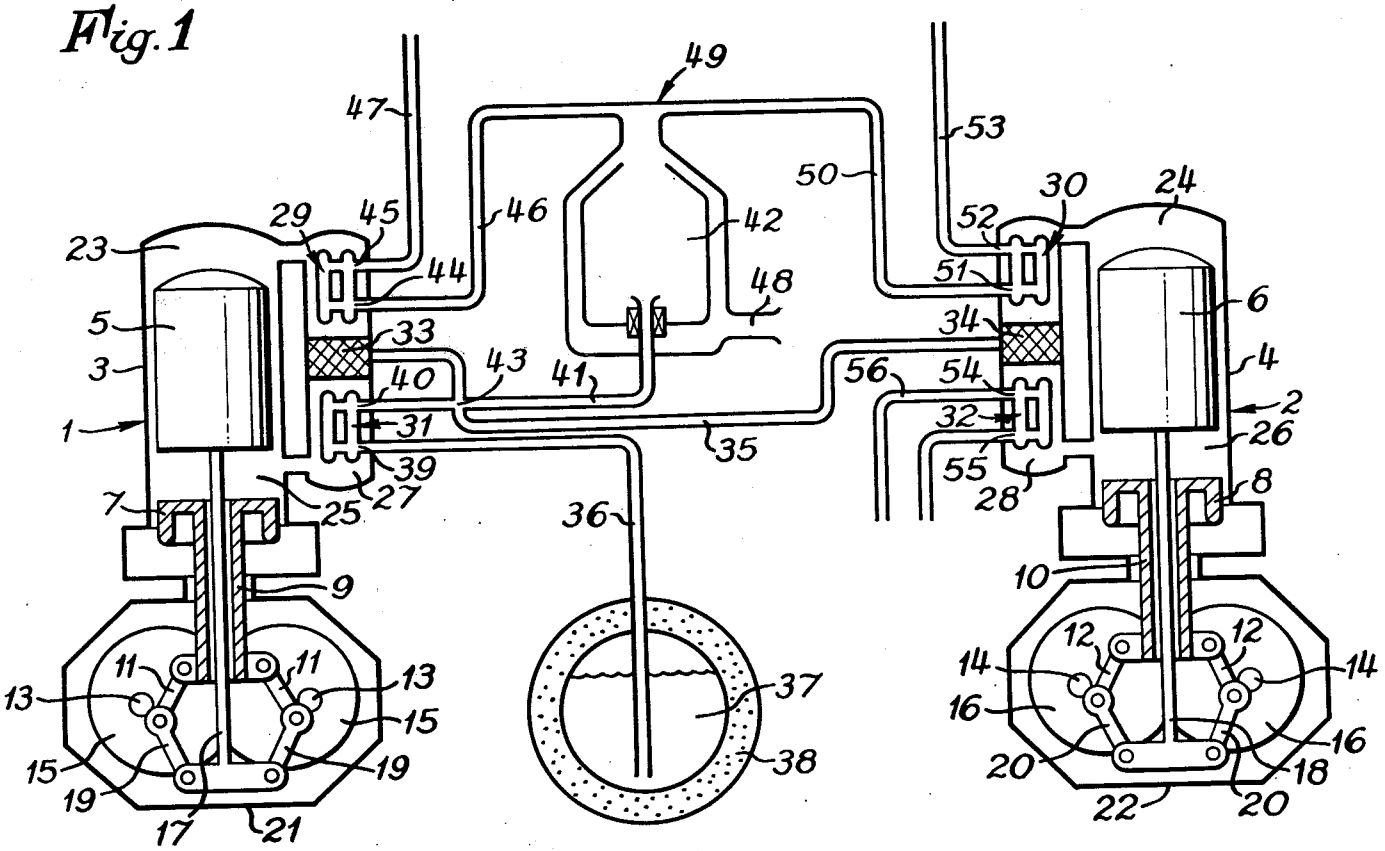
FIG. 1 is a diagrammatic view of a power plant including two hot gas engines.

Referring to FIG. 1 of the drawings, a power plant includes two hot gas engines 1 and 2. Each engine 1, 2 comprises a cylinder 3, 4 in which a displacer 5, 6 and a piston 7, 8 are adapted to move along a vertical axis.

Each piston 7, 8 is provided with a hollow piston rod 9, to which a respective pair of piston connecting rods 11, 12 is connected.

Each piston connecting rod 11, 12 is connected at one end to the respective hollow piston rod 9, 10 and at its other end to a respective one of a respective pair of cranks 13, 14.

Each pair of cranks 13, 14 is mounted on a pair of discs 15, 16 which are arranged to rotate on shafts in synchronism with one another, in phase and in opposite senses. The shafts are interconnected by gear wheels. Each displacer 5, 6 has secured to it a displacer rod 17, 18 which projects through the respective hollow piston rod 9, 10 and is connected to the respective pair of cranks 13, 14 by two displacer connecting rods 19, 20. The discs 15, 16, cranks 13, 14, displacer connecting rods 19, 20 and piston connecting rods 11, 12 are accommodated in a respective crank case 21, 22 which is secured to the respective cylinder 3, 4.

Each cylinder 1, 2 is divided by the respective displacer 5, 6 into two working fluid spaces which are commonly referred to as a hot space 23, 24 and a cold space 25, 26. Each hot space 23, 24 and the respective cold space 25, 26 are interconnected by a respective duct 27, 28 in which a heater 29, 30, a cooler 31, 32 and a regenerator 33, 34 are accommodated. Each heater 29, 30 is adjacent the respective hot space 23, 24 and each cooler 31, 32 is adjacent the respective cold space 25, 26, each regenerator 33, 34 being interposed between the respective heater 29, 30 and the respective cooler 31, 32. Each hot space 23, 24 and cold space 25, 26 contains hydrogen which is employed as working fluid. The passages through the regenerators 33, 34 for working fluid are interconnected by a conduit 35 so that working fluid can be extracted from and restored to the engines 1, 2 to achieve control of the output of the power plant when the power plant is in operation.

The cooler 31 has an inlet 39 which is connected to a conduit 36 which is adapted to convey liquid hydrogen 37 from a tank 38 to the cooler 31 for use as cooling fluid in the cooler 31. A conduit 41 interconnects an outlet 40 of the cooler 31 and a combustion chamber 42. The conduit 41 is adapted to convey hydrogen that has absorbed heat in the cooler 31 to the combustion chamber 42 for combustion of that hydrogen in the chamber 42. The conduit 41 communicates with the conduit 35 at a junction 43.

The heater 29 has an inlet 44 connected to a branch conduit 46 of a heat supply pipe 49, and an outlet 45 connected to an exhaust pipe 47. The branch conduit 46 of the heat supply pipe 49 interconnects the heater 29 and the combustion chamber 42, and is adapted to convey hot combustion gases from the combustion chamber 42 to the heater 29. The combustion chamber 42 has an air intake 48 which is adapted to draw air from the atmosphere for combustion in the chamber 42.

Another branch conduit 50 of the heat supply pipe 49 interconnects the combustion chamber 42 and the heater 30 which has an inlet 51 connected to that branch conduit 50 and an outlet 52 connected to an exhaust pipe 53.

The heater 30 is supplied with hot combustion gases drawn from the combustion chamber 42 and conveyed by the branch conduit 50 of the heat supply pipe 49, when the power plant is in operation. The cooler 32 has an inlet 54 connected to a conduit 56 which is adapted to convey water from a source of cold water to the cooler 32, and an outlet 55 for that water or water vapour heated in the cooler 32.

In operation of the power plant shown in FIG. 1, each piston 7, 8 moves from its bottom dead centre position to its top dead centre position and compresses working fluid in the respective cold space 25, 26 whilst heat is extracted from the compressed working fluid in each cold space 25, 26 by the respective cooler 31, 32. The compressed working fluid is forced from each cold space 25, 26 through the respective duct 27, 28 into the respective hot space 23, 24 by movement of each displacer 5, 6 towards the respective piston 7, 8. The compressed working fluid expands in each hot space 23, 24, the expanding working fluid driving the respective piston 7, 8 from its top dead centre position to its bottom dead centre position. Heat is supplied to the working fluid in each hot space 23, 24 from each heater 29, 30 during the expansion of the working fluid in the respective hot space 23, 24. Each cycle of operation of the power plant is concluded by return of the expanded working fluid from each hot space 23, 24 through the respective duct 27, 28 into the respective cold space 25, 26 by movement of each displacer 5, 6 away from the respective piston 7, 8.

Each regenerator 33, 34 extracts heat from the working fluid as it is transferred from each hot space 23, 24 to the respective cold space 25, 26 and restores heat to the working fluid as it is moved back from each cold space 25, 26 to the respective hot space 23, 24.

Liquid hydrogen 37 is drawn from the tank 38 and conveyed by the conduit 36 to the cooler 31 in which it is in heat exchange relationship with the working fluid in the cold space 25. Heat extracted from the working fluid in the cold space 25 by the cooler 31 is absorbed in the cooler 31 by the liquid hydrogen 37 which thereby is converted from the liquid state into the gaseous state or vapourous state. The vaporised or gasified hydrogen is then fed through the conduit 41 to the combustion chamber 42 in which the hydrogen gas or vapour together with air supplied through the air intake 48 is burnt.

A part of the total hot combustion gases is conveyed through the branch conduit 46 of the heat supply pipe 49 to the heater 29 in which it is in heat exchange relationship with the working fluid in the hot space 23. The cooled combustion gases are exhausted through the exhaust pipe 47 to atmosphere.

Another part of the total hot combustion gases is conveyed through the branch conduit 50 of the heat supply pipe 49 to the heater 30 in which it is in heat exchange relationship with the working fluid in the hot space 24. The cooled combustion gases are exhausted through the exhaust pipe 53 to atmosphere.

Cold water is fed to the cooler 32 and brought therein into heat exchange relationship with the working fluid in the cold space 26. Water heated by such heat exchange with working fluid in the cold space 26 is drained from the cooler 32 through a water outlet 62.

Figure 2:
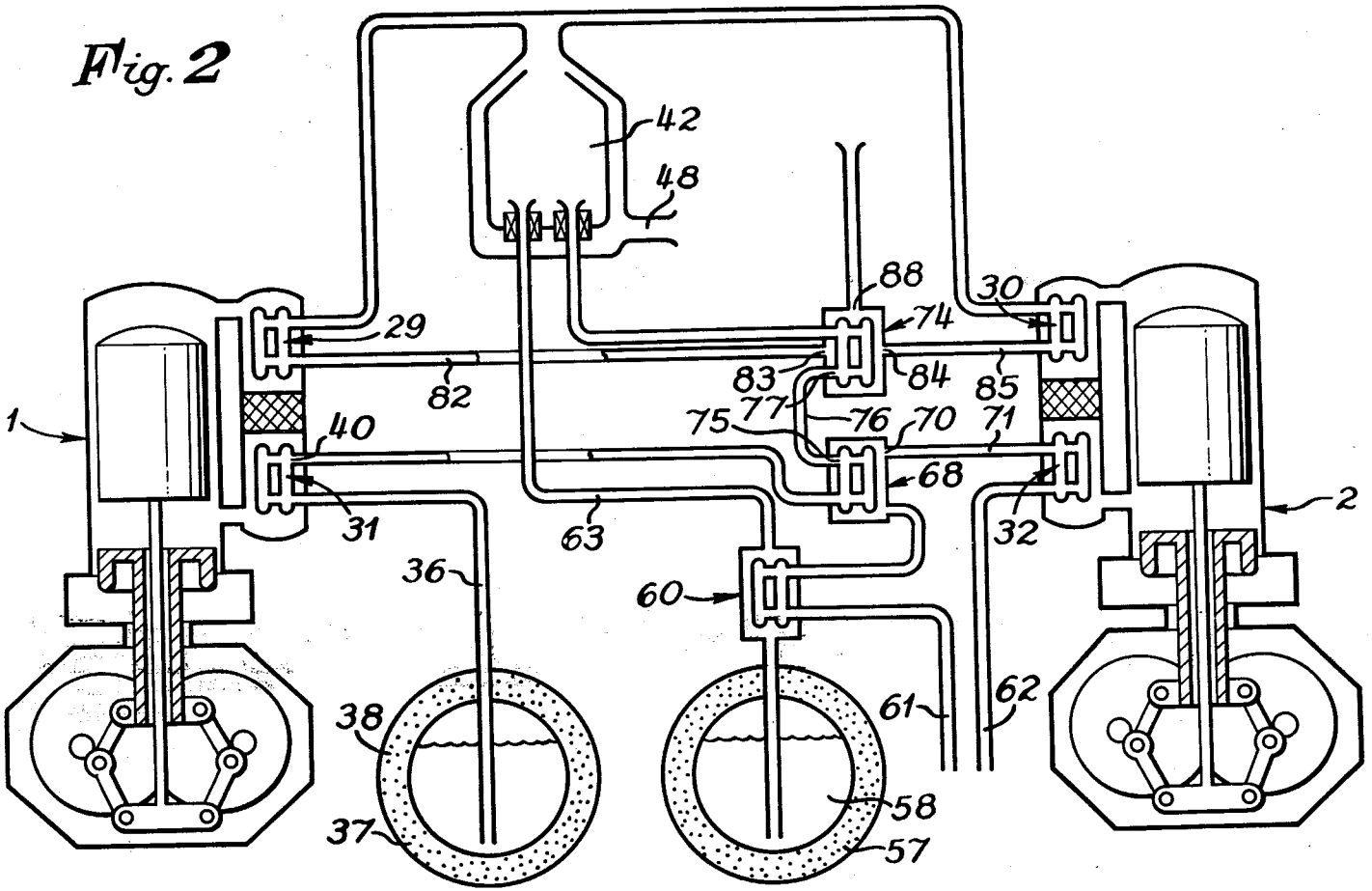
FIG. 2 illustrates a modification of the power plant shown in FIG. 1.

FIG. 2 illustrates a modification of the power plant that is illustrated in FIG. 1 of the drawings. Parts of the power plants that are shown in FIGS. 1 and 2 of the drawings which are similar are identified by the same reference numerals. The following description will be directed to those parts of the power plant that is shown in FIG. 2 which are not incorporated in the power plant that is shown in FIG. 1.

The gaseous or vapourous hydrogen that is fed to the combustion chamber 42 for combustion therein is heated before it reaches the combustion chamber 42 by being fed from the outlet 40 of the cooler 31 through a pair of series connected heat exchangers 68, 74 to the combustion chamber 42. The gaseous or vapourous hydrogen is brought into heat exchange in the heat exchanger 68 with cooling water that is fed from an outlet 70 of the heat exchanger 68 via conduit 71 to the cooler 32 of the engine 2, that cooling water being cooled by the heat exchange with the vapourous or gaseous hydrogen in the heat exchanger 68. Gaseous or vapourous hydrogen that emerges from another outlet 75 of the heat exchanger 68 is fed via a conduit 76 to an inlet 77 of the heat exchanger 74 wherein it is brought into heat exchange with the combustion gases that are exhausted from the heaters 29 and 30 of the two engines 1 and 2 and which are fed via conduits 82 and 85 to respective inlets 83 and 84 of the heat exchanger 74. The exhaust gases are vented to atmosphere through an exhaust gas outlet 88 of the heat exchanger 74.

Before being fed to the heat exchanger 68, the cooling water is cooled by heat exchange with liquid oxygen 58 in a heat exchanger 60. The liquid oxygen 58, which is drawn from a tank 57 in which it is stored, is gasified or vaporised by heat exchange with the cooling water in the heat exchanger 60. The cooling water is fed through a water inlet 61 into the heat exchanger 60. The gaseous or vapourous oxygen is fed via a conduit 63 from the heat exchanger 60 to the combustion chamber 42 in which it serves, together with air drawn through the air intake 48, as an oxidant for the combustion of hydrogen in the combustion chamber 42.

Figure 3:
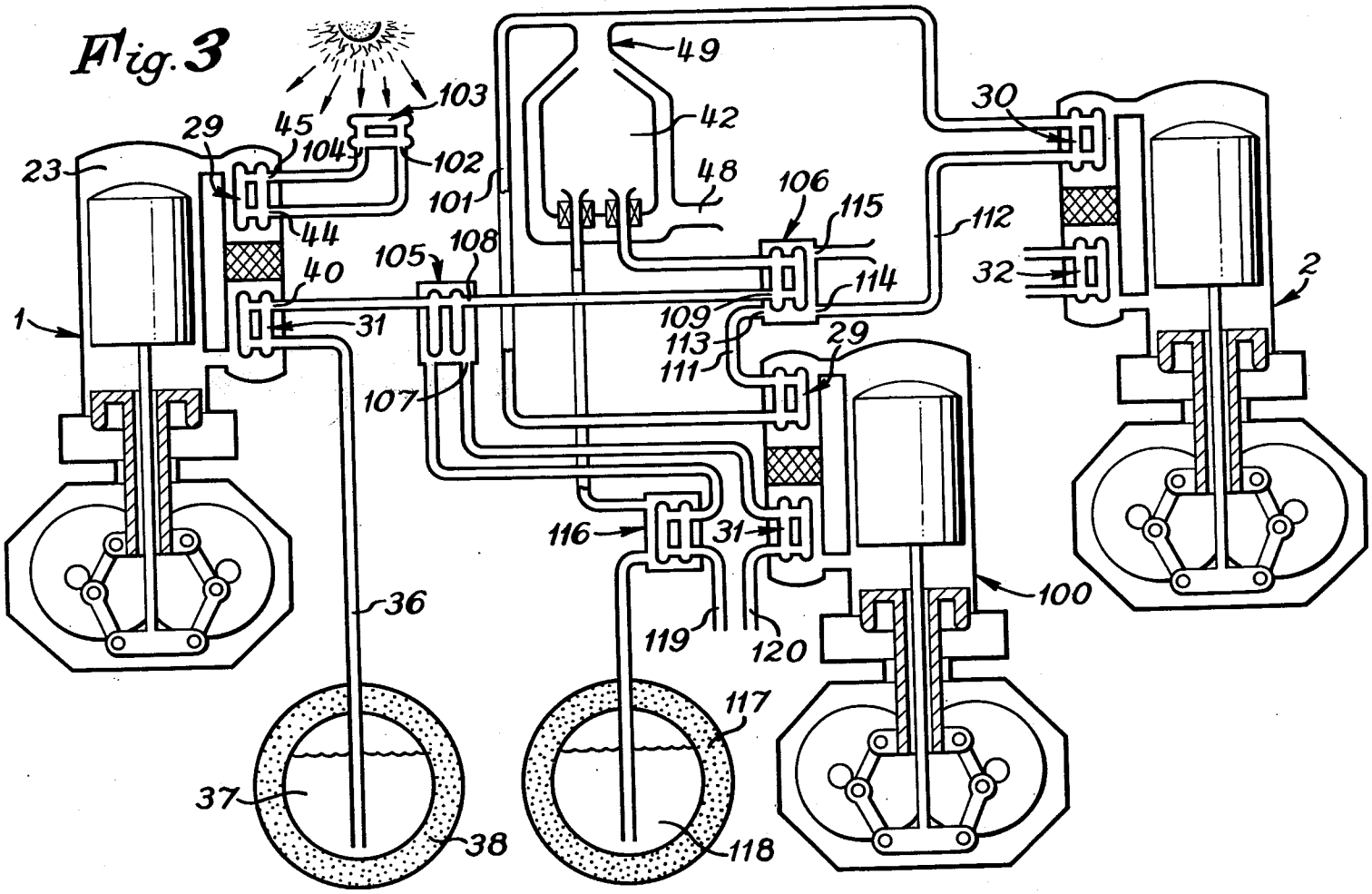
FIG. 3 illustrates another modification of the power plant shown in FIG. 1 which includes three hot gas engines.

FIG. 3 illustrates another modification of the power plant that is illustrated in FIG. 1 of the drawings. Parts of the power plant that are shown in FIGS. 1 and 3 of the drawings which are similar are indicated by the same reference numerals. The following description will be directed to those parts of the power plant that is shown in FIG. 3 which are not incorporated in the power plant that is shown in FIG. 1.

The power plant shown in FIG. 3 includes a third hot-gas engine 100 which is similar in construction to the hot-gas engines 1 and 2. The component parts of the hot-gas engine 100 are identified by the reference numerals that identify the corresponding parts of the hot-gas engine 1.

The heat supply pipe 49 from the combustion chamber 42 is not connected to the heater 29 of the engine 1 as it is in the power plant that is shown in FIG. 1, but is connected by a branch conduit 101 to the heater 29 of the engine 100.

The heater 29 of the engine 1 has its inlet 44 connected to an outlet 102 of a solar heat exchanger 103 and its outlet 45 connected to an inlet 104 of the solar heat exchanger 103. Fluid in the solar heat exchanger 103 is heated by solar energy and the heated fluid is conveyed to the heater 29 of the engine 1 where it heats working fluid in the associated hot space 23 before being returned to the solar heat exchanger 103 for reheating.

The gaseous or vaporous hydrogen that is fed to the combustion chamber 42 for combustion therein is heated before it reaches the combustion chamber 42 by being fed from the outlet 40 of the cooler 31 of the engine 1 through a pair of series connected heat exchangers 105 and 106 to the combustion chamber 42. The gaseous or vaporous hydrogen is brought into heat exchange in the heat exchanger 105 with cooling water that is fed from an outlet 107 of the heat exchanger 105 to the cooler 31 of engine 100, that cooling water being cooled by the heat exchange with the vapourous or gaseous hydrogen in the heat exchanger 105. The cooling water is drained from the cooler 31 of engine 100 through a water outlet 120. Gaseous or vapourous hydrogen that emerges from another outlet 108 of the heat exchanger 105 is fed to an inlet 109 of the heat exchanger 106 wherein it is brought into heat exchange with the combustion gases that are exhausted from the heaters 29 and 30 of the engines 100 and 2 which are fed via conduits 111 and 112 to respective inlets 113 and 114 of the heat exchanger 106. The exhaust gases are vented to atmosphere through an exhaust gas outlet 115 of the heat exchanger 106.

Before being fed to the heat exchanger 105, the cooling water is cooled by heat exchange with liquid oxygen 118 in a heat exchanger 116. The cooling water is fed to the heat exchanger 116 through a water inlet 119. The liquid oxygen 118, which is drawn from a tank 117 in which it is stored, is gasified or vapourised in the heat exchanger 116. The gaseous or vapourous oxygen is fed from the heat exchanger 116 to the combustion chamber 42 in which it serves together with air drawn through the air intake 48, as an oxidant for the combustion of hydrogen in the combustion chamber 42.

The cooling water that is passed through the cooler 32 of the engine 2 conveniently is river water.

Liquid air may be used instead of liquid oxygen in the power plants described above with reference to FIGS. 2 and 3. The heat exchanger 60, 116 may be downstream of the heat exchanger 68, 105 having regard to the direction of flow of water through those heat exchangers. River water may be used instead of fluid heated by solar energy for supply to the heater 29 of the engine 1 in the power plant shown in FIG. 3.

Vapourous or gaseous oxygen fed to the combustion chamber 42 may be sufficient for supporting combustion of hydrogen gas or vapour in the combustion chamber 52 so that the air intake 48 can be omitted from the combustion chamber 42 in the power plant shown in FIGS. 2 and 3.

What we claim is:

1. A power plant comprising combustion means for generating heat for use in a power plant with at least two hot gas engines, such engine comprising: first and second working fluid spaces, regenerative heat exchange means in communication with said first and second working fluid spaces, reciprocating means for varying the volume to said working fluid spaces, heating means for heating working fluid in said first working fluid space, cooling means adjacent to said second working fluid space, a source of cooling fluid and first conduit means connecting said source of cooling fluid and said cooling means to convey cooling fluid from said source of cooling fluid to said cooling means to cool working fluid in said second working fluid space; means for conveying the products of combustion from said combustion means to the heating means of said two hot gas engines to heat working fluid in said first working fluid space of the respective engines; second conduit means in communication with cooling means of said one hot gas engine and the combustion means to convey cooling fluid from said cooling means of said one hot gas engine to the combustion means combusiton therein, the cooling means of said second hot gas engine being independent of the combustion means, a further source of cooling fluid, third conduit means in communication with said further source of cooling fluid to said combustion means for combustion therein, and heat exchange means for transferring heat from cooling fluid fed to said independent cooling means to the cooling fluid fed from said further source of cooling fluid to said combustion means wherein, in operation of the plant, said cooling fluid fed from said further source of cooling fluid to said combustion means has had its physical state changed by heat which it absorbed in the cooling means of said one hot gas engine.

2. A power plant as claimed 1 comprising second heat exchange means for transferring heat from cooling fluid fed to said independent cooling means to cooling fluid fed from the cooling means of said at least one hot gas engine to the combustion means.

3. A power plant as claimed in claim 2 comprising third heat exchange means connected to said second conduit means and means for passing the products of combustion through said third heat exchange means to heat cooling fluid fed from the cooling means of said one hot gas engine to the combustion means before that cooling fluid enters the combustion means.

4. A power plant as claimed in claim 3 comprising more than two hot gas engines, the heating means of at least one hot gas engine which includes cooling means that are in communications with said combustion means being adapted to be supplied with solar energy for heating working fluid in said first working fluid space of that hot gas engine.

5. A power plant as claimed in claim 3 comprising more than two hot gas engines, the heating means of at least one hot gas engine which includes cooling means that are connected to the combustion means being adapted to be supplied with heat extracted from river water for heating working fluid in said first working fluid space of said hot gas engine.

6. A power plant as claimed in claim 5 comprising fourth conduit means interconnecting said second conduit means and said first and second working fluid spaces of at least one hot gas engine.

7. A power plant as claimed in claim 6 comprising fifth conduit means interconnecting the regenerative heat exchange means of at least two hot gas engines.

8. A power plant comprising combustion means for generating heat for use in a power plant with at least two hot gas engines, each of said engines comprising first and second working fluid spaces, reciprocating means for varying the volume of working fluid spaces, heating means adjacent said first working fluid space, a source of cooling fluid, first conduit means connecting said source of cooling fluid and said cooling means to convey cooling fluid from said source of cooling fluid to said cooling means to cool working fluid in said second working fluid space and means for conveying the products of combustion from said combustion means to the heating means to heat working fluid in said first working fluid space; second conduit means in communication with the cooling means of one of said hot gas engines and the cmbustion means to convey cooling fluid from the cooling means of said one hot gas engine to the combustion means for participation in combustion therein, the cooling means of said second hot gas engine, being independent of the combustion means; and heat exchange means for transferring heat from cooling fluid fed to said independent cooling fluid fed from the cooling means of said one hot gas engine to the combustion means wherein, in operation of the plant, the cooling fluid fed from the cooling means of said one hot gas engine to the combustion means has had its physical state changed by heat which it absorbed in the cooling means of said one hot gas engine.

* * * * *

UNITED STATES PATENT OFFICE

CERTIFICATE OF CORRECTION

Patent No. 4,020,635 Dated May 3, 1977

Inventor(s) Brian Joynes et al.

It is certified that error appears in the above-identified patent and that said Letters Patent are hereby corrected as shown below:

On the cover sheet, Item (73) Assignee should read:

-- Automotive Products Ltd., England --.

Signed and Sealed this

Seventh Day of March 1978

[SEAL]

*Attest:*

RUTH C. MASON
*Attesting Officer*

LUTRELLE F. PARKER
*Acting Commissioner of Patents and Trademarks*